US011398211B2

(12) United States Patent
Noel et al.

(10) Patent No.: US 11,398,211 B2
(45) Date of Patent: Jul. 26, 2022

(54) HAPTIC CONTROLLER

(71) Applicant: EXPRESSIVE, Montreuil (FR)

(72) Inventors: Benjamin Noel, Jurancon (FR); Stéphane Falanchere, Paris (FR); Alexandre Bellot, Boulogne-Billancourt (FR); Victor Grimaldi, Caudecoste (FR)

( * ) Notice: Subject to any disclaimer, the term of this patent is extended or adjusted under 35 U.S.C. 154(b) by 0 days.

(21) Appl. No.: 17/260,629

(22) PCT Filed: Jul. 18, 2019

(86) PCT No.: PCT/FR2019/051811

§ 371 (c)(1),
(2) Date: Jan. 15, 2021

(87) PCT Pub. No.: WO2020/016536

PCT Pub. Date: Jan. 23, 2020

(65) Prior Publication Data

US 2021/0280159 A1 Sep. 9, 2021

(30) Foreign Application Priority Data

Jul. 18, 2018 (FR) ..... 18 56663

(51) Int. Cl.
*G10H 1/34* (2006.01)

(52) U.S. Cl.
CPC ..... *G10H 1/346* (2013.01); *G10H 2220/311* (2013.01)

(58) Field of Classification Search
CPC ..... G10H 1/346
See application file for complete search history.

(56) References Cited

U.S. PATENT DOCUMENTS 4,128,035 A * 12/1978 Erickson ..... G10C 3/12 84/433
4,376,238 A * 3/1983 Martin ..... H01H 13/06 200/1 B (Continued)

FOREIGN PATENT DOCUMENTS

DE 102018002577 A1 10/2018
JP S63 146098 A 6/1988

(Continued)

OTHER PUBLICATIONS

Machine translation of JPS63146098.
English language abstract of JPH04171620.

*Primary Examiner* — Robert W Horn
(74) *Attorney, Agent, or Firm* — Robert Facey; Adam Lewental

(57) ABSTRACT

A haptic controller including a base, a plurality of actuators, each actuator being mounted pivotally relative to the base along a pivoting axis perpendicular to the main direction, a plurality of damping elements, each being positioned so as to dampen a rotation movement of an actuator, the damping elements being elastically deformable between an initial configuration and a final configuration, each damping element including a body of deformable material, the body having at least one recess, wherein, each of the actuators have a protrusion suitable for coming into contact with the associated damping element, and each protrusion has a free end defining a contact with the associated damping element in its initial configuration.

18 Claims, 10 Drawing Sheets

(56) References Cited

U.S. PATENT DOCUMENTS 4,668,843 A * 5/1987 Watanabe ..... H01H 13/64 200/5 A
4,775,574 A * 10/1988 Fukushima ..... H01H 13/702 200/345
5,158,003 A * 10/1992 Lee ..... G10H 1/346 84/439
5,168,982 A * 12/1992 Hakanen ..... H01H 13/18 200/330
5,821,443 A * 10/1998 Masubushi ..... G10H 1/346 84/433
5,824,978 A * 10/1998 Karasik ..... H01H 13/702 200/18
5,952,629 A * 9/1999 Yoshinaga ..... H01H 13/80 200/5 A
6,002,078 A * 12/1999 Yoshinaga ..... G10H 1/344 84/423 R
6,162,980 A * 12/2000 Kitashima ..... G10H 1/346 84/423 R
6,765,142 B2 * 7/2004 Sakurada ..... G10H 1/346 84/600
6,849,796 B2 * 2/2005 Yamaguchi ..... G10H 1/344 84/720
6,927,352 B2 * 8/2005 Bouche ..... H01H 59/0009 335/85
7,176,370 B2 * 2/2007 Osuga ..... G10C 3/12 84/423 R
7,256,359 B2 * 8/2007 Nishida ..... G10H 1/346 200/1 B
7,427,723 B2 * 9/2008 Watanabe ..... G10H 1/344 200/343
8,716,588 B2 * 5/2014 Yoshida ..... G10H 1/34 84/745
8,766,076 B2 * 7/2014 Ishida ..... G10H 1/348 84/433
9,040,807 B2 * 5/2015 Osuga ..... G10H 1/346 84/744
9,269,336 B2 * 2/2016 Osuga ..... G10C 3/12
9,424,825 B2 * 8/2016 Osuga ..... G10H 1/34
10,304,433 B2 * 5/2019 Kuno ..... G10H 1/346
10,431,403 B2 * 10/2019 Tanoue ..... G10H 1/0008
10,482,851 B2 * 11/2019 Kuno ..... G10C 3/02
10,482,861 B2 * 11/2019 Harimoto ..... G10H 1/34
10,553,189 B2 * 2/2020 Ichiki ..... G10H 1/34
10,614,781 B2 * 4/2020 Ichiki ..... G10H 1/34
10,692,478 B2 6/2020 Ichiki et al.
10,720,131 B2 * 7/2020 Yamamoto ..... G10H 1/346
10,937,403 B2 * 3/2021 Nishida ..... G10H 7/02
2015/0302841 A1 * 10/2015 Quartier ..... G10H 1/34 84/600
2018/0286605 A1 10/2018 Tanoue
2020/0005751 A1 * 1/2020 Tanoue ..... G10H 1/346
2020/0088258 A1 * 3/2020 Tanoue ..... F16F 1/376
2021/0280159 A1 * 9/2021 Noel ..... G10H 1/346

FOREIGN PATENT DOCUMENTS

JP H04 171620 A 6/1992
WO 2018131604 A1 7/2018

* cited by examiner

FIG.11
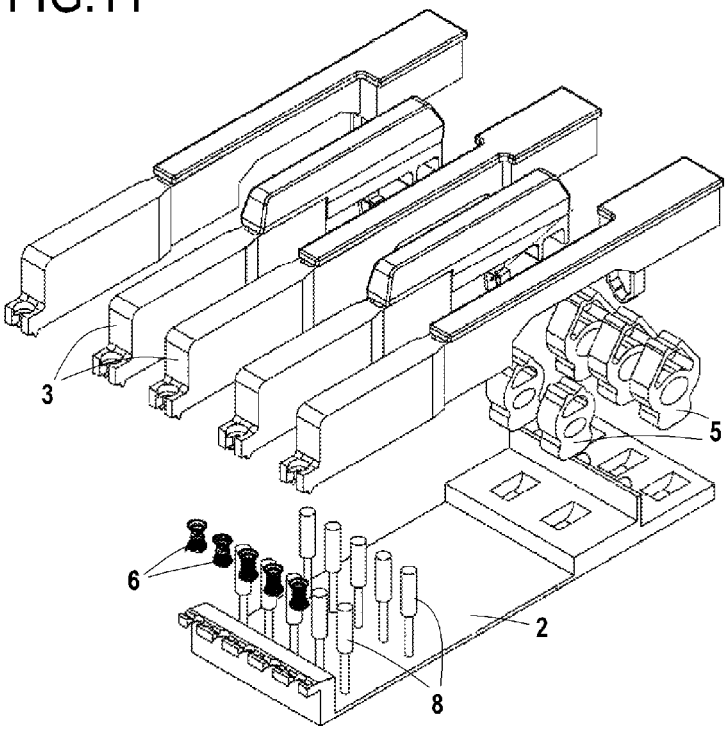
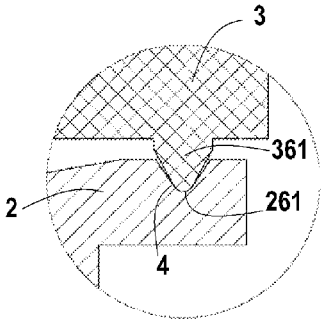
FIG.13
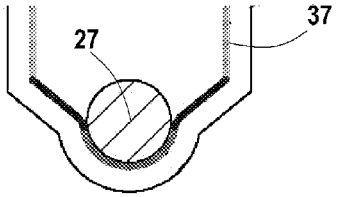
FIG.14

HAPTIC CONTROLLER

FIELD

The present disclosure relates to the field of controllers used in the musical field, and relates more precisely to a keyboard-type device.

BACKGROUND

Equipment of the keyboard type is commonly employed in the musical field, particularly due to the fact of their capacity to allow controlling and generating multiple and varied sounds and signals.

However, this equipment is commonly limited by its very structure, which is that of a piano type keyboard. Numerous devices have been proposed aiming in particular to reproduced in the most faithful manner possible the sensation produced by a piano keyboard.

Known in particular are different devices aiming to respond to the need for continuous control for playing certain sounds other than a traditional piano, one of these functionalities being commonly designated by the term "aftertouch." However, the devices proposed to this day have very limited functionalities and a control amplitude that is too small to really be able to offer perspectives of satisfactory play.

Here it is therefore desired to propose a controller allowing more numerous and varied setpoints than a conventional keyboard.

SUMMARY

The present disclosure relates to a haptic controller comprising a base, a plurality of actuators, each having a shape elongated in a main direction, each actuator being mounted pivotally relative to the base along a pivoting axis perpendicular to the main direction, a plurality of damping elements, each damping element being positioned so as to dampen a rotation movement of an actuator around the pivoting axis in a compression direction, the damping elements being elastically deformable between an initial configuration and a final configuration, each damping element comprising a body of deformable material, the body having at least one recess, and wherein each of the actuators have a protrusion suitable for coming into contact with the associated damping element, and each protrusion has a free end defining a contact, linear for example, with the associated damping element in its initial configuration.

According to one example, the body of each damping element has at least two recesses.

The recesses may have distinct shapes.

According to one example, the damping elements are removable.

According to one example, the base defines an abutment limiting the displacement in rotation of each actuator in the compression direction.

According to one example, the base and the actuators include means cooperating so as to define an abutment limiting the displacement in rotation of each actuator in the direction opposite to the compression direction, defining an initial position of each actuator on their associated damping elements in which the damping elements are preloaded by the actuators.

According to one example, each of the actuators include a tactile portion and a foot, the tactile portion being movable in translation relative to the foot in a direction defined by the pivoting axis.

The foot of each actuator may include a pivoting portion defining the pivoting link with the base, the pivoting portion being connected to the tactile portion by two parallel slats each extending in a plane perpendicular to the pivoting axis.

According to one example, the foot of each actuator includes a pivoting portion defining a pivoting link with the base, and allowing displacement in rotation of the actuator along an axis perpendicular to the pivoting axis and perpendicular to the main direction.

According to one example, the base includes a plurality of elements protruding from the base, each element being configured so as to be supported against two walls of the foot of an actuator in a direction parallel to the pivoting axis, there may be two internal walls or two external walls opposite to the foot of an actuator in a direction parallel to the pivoting axis.

According to one example, the base includes a plurality of elements protruding from the base, each element being configured so as to be supported against two internal wall of the foot of an actuator in a direction parallel to the pivoting axis. The elements may be rods.

As an option, the actuators are configured so as to allow variable displacement in translation depending on the rotation of the actuators around the pivoting axis.

As an option, the damping element is connected to the base by means of a linking portion extending in a direction perpendicular to the pivoting axis or in a direction parallel to the pivoting axis.

According to one example, the damping element has a variable thickness, the thickness being measured in a direction defined by the contact, possibly linear, between the actuator and the damping element, or possibly by the pivoting axis.

According to one example, the body of each damping element has a cylindrical shape, of revolution for example, along an axis parallel to the pivoting axis, the at least one recess of each damping element being through in a direction defined by the pivoting axis.

According to one example, each actuator includes two distinct linking elements forming two pivoting links separate from the base along the pivoting axis.

According to one example, the damping elements are configured so as to dampen the rotation movement of the actuator by opposing a damping having two distinct profiles depending on the rotation of the associated actuator, the passage from the first to the second profile defining a break in a damping curve depending on the rotation of the actuator.

BRIEF DESCRIPTION OF THE DRAWINGS

The disclosure and its advantages will be better understood upon reading the detailed description provided hereafter of different embodiments of the disclosure given by way of non-limiting examples. This description refers to the appended pages of figures, in which:

FIGS. 10 to 14 show several views of another embodiment of a device according to an aspect of the disclosure.

In all the figures, identical elements are labeled with common numerical symbols.

DETAILED DESCRIPTION

Figure 1:
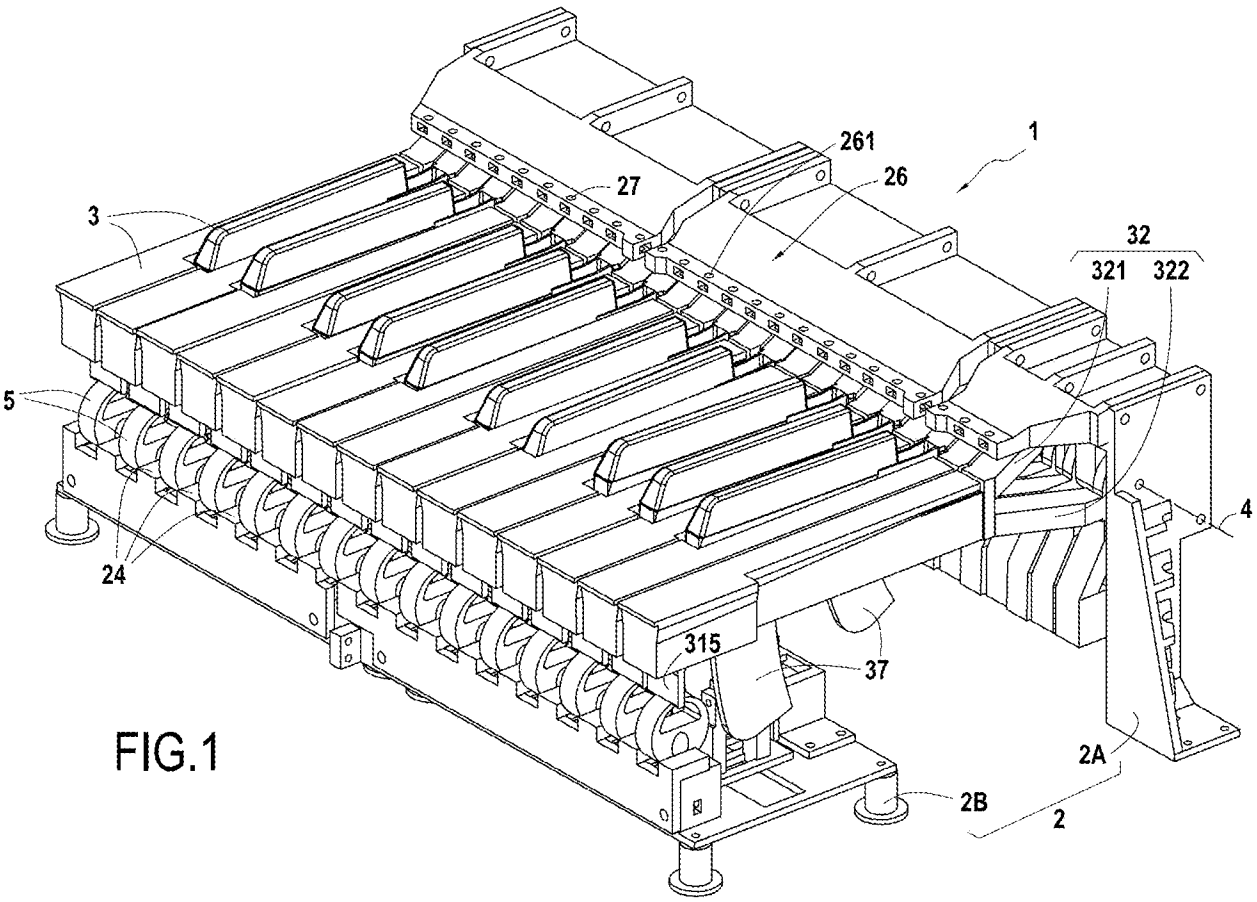
FIG. 1 shows an example of a device according to one aspect of the disclosure.

FIGS. 1 to 4 show an example of a device 1 according to one aspect of the present disclosure.

Represented in the figures is a device 1 comprising a base 2 and a plurality of actuators 3, configured here so as to form a piano type keyboard, the actuators 3 forming here the keys of a piano.

The actuators 3 are each mounted movable in rotation relative to the base 2 via a pivoting link around the same pivoting axis 4 of the base 2. The pivoting axis 4 can be formed from a plurality of segments with aligned axes, or by a continuous axis, provided that it allows ensuring a common axis of rotation for the actuators 3 relative to the base 2. More generally, the pivoting axis 4 generally designates an axis of rotation of the actuators 3 relative to the base 2, but does not necessarily correspond to a physical element. The actuators 3 each extend in a main direction, perpendicular to the pivoting axis 4.

The pivoting link can be accomplished in different manners. The illustrated embodiment shows a pivoting link accomplished by means of an element forming an axis around which are positioned segments of the actuators 3 forming cylindrical sleeves. It is understood, however, that this embodiment is not limiting; the pivoting link can be accomplished in any other suitable manner, provided that the relative movement of the actuators 3 relative to the base 2 is limited to a rotation movement.

The actuators 3 can thus be manipulated by a user who may exert a pressure force on a portion of a given actuator in order to cause a rotation movement of the actuator 3 around the pivoting axis 4 in a direction that is designated as depression.

This rotation movement in the depression direction is dampened by a damping element 5 positioned between each actuator 3 and the base 2. The device 1 thus may include as many damping elements 5 as actuators 3.

The rotation movement of each actuator 3 in the depression direction may be limited by a stop (or abutment) 24 of the base 2, configured so as to define a maximum rotation of each actuator in the depression direction. The rotation movement of each actuator 3 in the depression direction may thus be accomplished between an initial position, in which no force is exerted by a user on the actuator 3, and a depressed position, in which the actuator 3 is in contact with the associated stop 24.

In the example shown in FIGS. 1 to 4, the base is in two portions 2A and 2B, a first portion 2A of the base forms the support of the pivoting axis 4, while a second portion 2B of the of the base forms a support for the damping elements 5. In an embodiment of this type, the two portions 2A and 2B of the base 2 may secured to the same base in order to ensure the alignment of the different components.

The rotation movement in the direction opposite to the depression direction may, for its part, be limited by a stop formed by the base 2, so as to prevent lifting of the actuators 3 or a rebound effect of the actuators 3. In the example shown in FIG. 1, the base 2 has a portion forming a cover 26 covering a portion of the actuators 3 near the pivoting axis 4. This portion forming a cover 26 may have a plurality of slots 261 allowing for example adjustable stops, such as threaded rods to be inserted into it, thus allowing limiting the rotation movement of the actuators 3 in the direction opposite to the depression direction. The addition of stops of this type allows in particular ensuring the alignment of the different actuators in their initial position (i.e. when a user is not applying a force on the actuators 3), and also allows defining an initial position for the actuators 3 on their associated damping elements 5 in which the damping elements are preloaded by the actuators 3, so as to both ensure a return to the initial position and maintenance of the contact of each actuator 3 with its damping element 5.

It is understood that preloading depends in particular on the shape and on the dimension of the damping elements 5. An increase in the size of the damping element causes an increase in preloading, and conversely.

Figure 3:
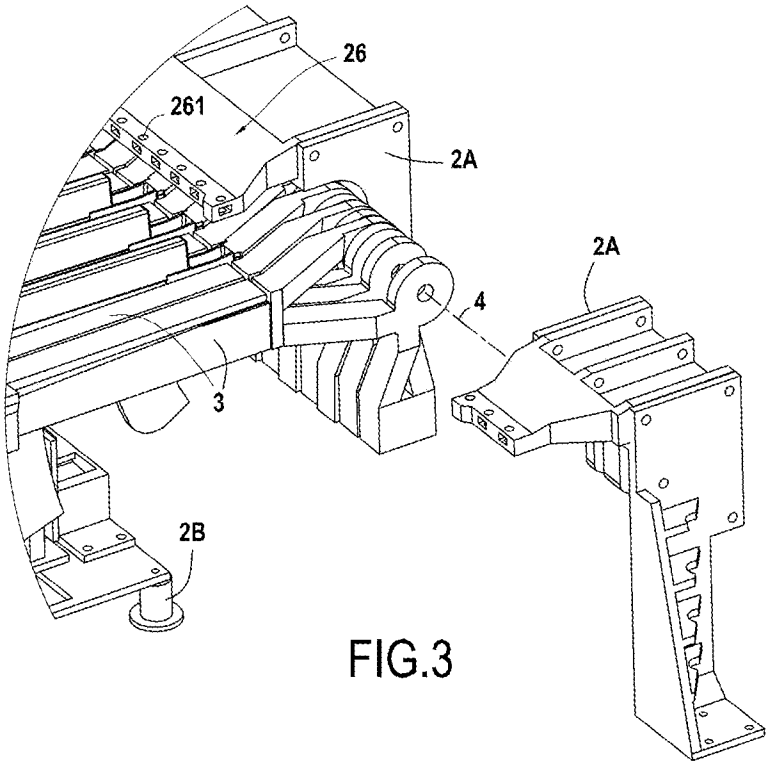
FIGS. 2 to 7 are detailed views of FIG. 1.
Figure 2:
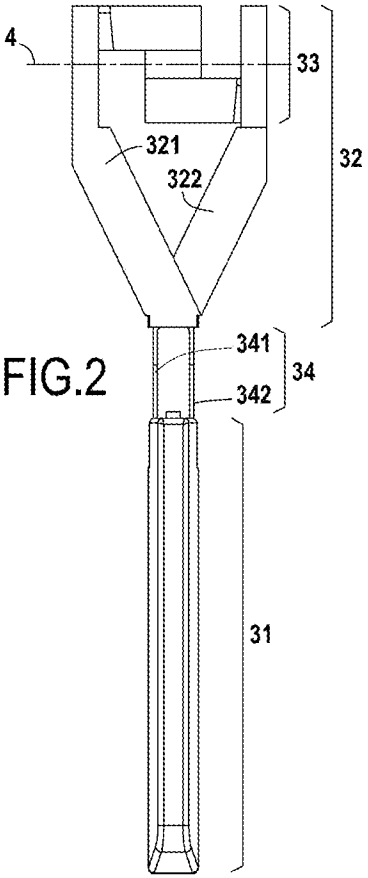

At present, an example of the structure of the actuators 3 is described with reference in particular to FIGS. 2 and 3.

The actuator 3 as shown includes a tactile portion 31 forming a free end of the actuator, and a foot 32 comprising a pivoting portion 33 forming the pivoting link with the pivoting axis 4 of the base 2.

The tactile portion 31 is the portion of the actuator 3 intended to be manipulated by the user. Thus it may have a flat upper face and a lower face, the upper face being able to include a coating such as a wood veneer or other element surrounding the tactile portion 31 so as to improve the sensation of the user. It is understood that the user can also manipulate the actuator 3 via the foot 32.

An intermediate portion34 comprising two parallel slats341 and 342 and extending in two distinct planes and each perpendicular to the pivoting axis 4 may realize the link between the tactile portion 31 and the foot 32 of each actuator 3. The slats 341 and 342 may be made of elastic material, or more generally of material allowing elastic deformation to occur when subjected to a moderate force on the part of a user, of plastic material (for example of acrylonitrile butadiene styrene, polycarbonate or polyoxymethylene) for example, of metallic material (for example steel or stainless steel).

An intermediate portion of this type 34 allows a translation movement 31 relative to the foot 32 in the direction defined by the pivoting axis 4, and therefore offers an additional degree of freedom for the actuators 3. By way of an example, this translation movement can allow transmitting a signal of the "vibrato" type for music processing.

Alternatively, the pivoting link accomplished between each actuator 3 and the pivoting axis 4 is configured so as to allow a limited rotation movement along an axis perpendicular to the pivoting axis 4 and perpendicular to the main direction of the actuator 3 in question. An embodiment of this type thus allow obtaining a moderate displacement of the free end of the actuator 3, to allow a vibrato effect to be achieved.

Figure 6:
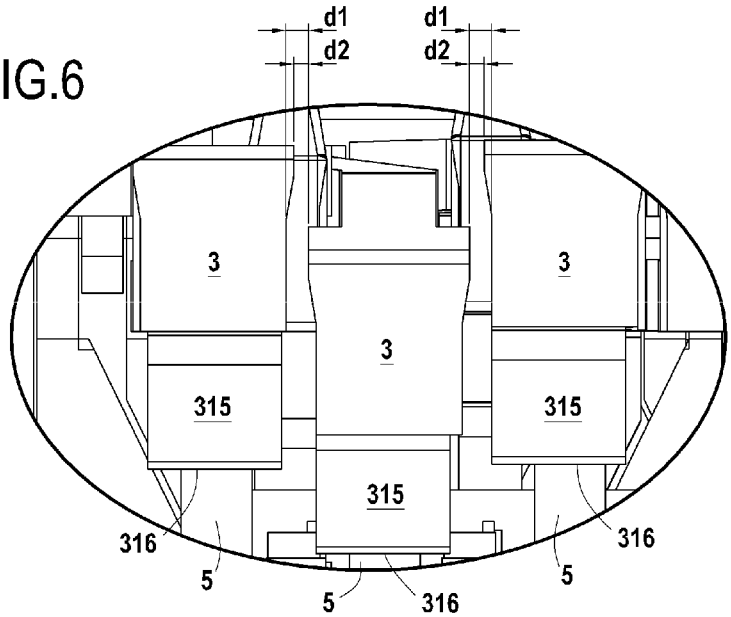
Figure 7:
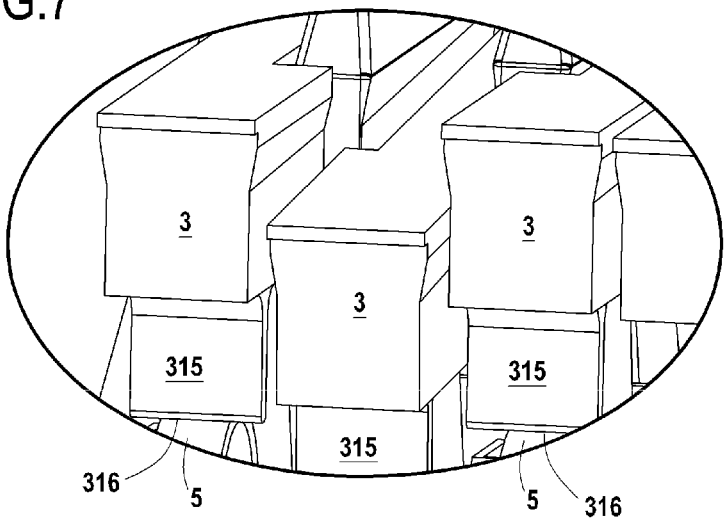

The tactile portion 31 of the actuators 3 may have a decreasing cross section from the upper face toward the lower face, which allows offering a greater translation displacement when an actuator 3 has been subjected to a pressure force by the user and has therefore performed a rotation movement around the pivoting axis 4 relative to the adjacent actuators 3. FIGS. 6 and 7 thus illustrate the difference in translation displacement between an actuator 3 in its neutral position (i.e. in the absence of a force exerted by a user), and an actuator 3 in the depressed position (i.e. having performed a rotation movement around the pivoting axis 4 under the influence of a force exerted by a user). Denoted respectively by d1 and d2 in FIG. 6 are the possible displacements in these two positions toward an adjacent actuator. It is seen that the amplitude of this displacement is increased as a function of the reduction of cross section of the actuator adjacent to the actuator in question. The change in cross section can be adjusted, depending on whether it is desired to have a displacement amplitude that varies progressively, or which attains its maximum value directly. The change in cross section can thus form a slope or a notch.

In the example shown, it is seen that the upper face 3 of each actuator 3 is a thin plate, followed by an isosceles trapezoid transition portion 35 thus reducing the thickness of the actuator 3 from the upper surface toward the lower surface of the actuator 3, then a portion with a rectangular cross section in the continuation of the smallest foot of the trapezoidal portion.

In terms of application, these features thus allow a user to accomplish a greater vibrato movement when he exerts a greater pressure on the actuator in question.

In the example shown, the foot 32 of the actuator 3 includes two distinct arms321 and 322 each forming a link element with the pivoting axis 4 and thus defining two distinct pivoting links separate from the base 2.

Such an embodiment allows increasing the width of the pivoting link between the base 2 and the actuator 3, which allow minimizing the radial clearance resulting from this pivoting link.

In an embodiment of this type, the different arms of the actuators 3 may be positioned staggered (as can be seen in particular in FIG. 3, which is a partially exploded view of one zone of FIG. 1), so that one or two arms of adjacent actuators are interposed between two arms 321 and 322 of the same actuator, which thus allows increasing the width of the pivoting link as previously indicated, while minimizing the necessary volume for making all the pivoting links between the actuators 3 and the base 2.

Depending on the desired configuration for the device 1, the latter can have actuators 3 having different shapes. In the example shown in FIG. 1, two distinct types of actuators 3 are distinguished, so as to form a keyboard similar to a piano keyboard.

As previously indicated, damping elements 5 are positioned between each actuator 3 and the base 2 so as to dampen the rotation movement of the actuators 3 in a direction characterized as the depression direction, which corresponds to the direction of rotation of the actuator 3 when a user exerts a pressure force on the upper face of the tactile portion 31 of the actuator 3 in question.

The different damping elements 5 can be separate, or be grouped into subassemblies linked by a foot or strip. It is possible for example to create all or a portion of the damping elements 5 in a single piece, the different damping elements 5 being linked by a strip or a bar extending along the axis of rotation.

In the example shown, the damping elements 5 are positioned below the tactile portion 31 of the actuators 3, the lower face of each actuator comprising here a protrusion 315 having a free end 316 suitable for coming into contact with the associated damping element 5.

Defined for each damping element 5 is an initial configuration, corresponding to the shape of the damping element in the absence of deformation, which may be when no force is applied to the associated actuator 3, and a final configuration, corresponding to the maximum deformation of the damping device 5 upon displacement of the associated actuator 3, the final configuration may be determined by the stop 24 associated with the actuator 3.

The protrusions 315 and the damping elements 5 are configured to define a contact, which may be linear, when the damping element 5 is in its initial configuration. Each of the protrusions 315 thus protrudes from a surface of the associated actuator 3, and has a free end 316 coming into contact with a damping element 5.

What is meant by linear contact is at least one linear contact between the protrusions 315 and the damping elements 5. It is understood that the linear contact necessarily extends over a given surface due to the deformation of the components. The notion of linear is to be understood with reference to the respective dimensions of the components.

The free end 316 of each protrusion may have a cross section forming a circular arc, which thus allows not damaging the damping element 5.

The protrusions 315 may have:

- a length, measured in a vertical direction, which is greater than the height of the associated damping element 5, or may be greater than half the height of the associated damping element,
- a width measured in the direction defined by the pivoting axis 4 greater than the width of the associated damping element 5 measured in the direction defined by the pivoting axis 4 or included between 1 and 4 times or between 1 and three times the width of the associated damping element 5 measured in the direction defined by the pivoting axis 4,
- a thickness measured in a horizontal direction and perpendicular to the pivoting axis 4 less than a third or a quarter of the maximum thickness of the cylinder measure in a horizontal direction perpendicular to the pivoting axis 4, corresponding in the illustrated example to a diameter of the cylindrical body 51 of the damping element 5.

Figure 5:
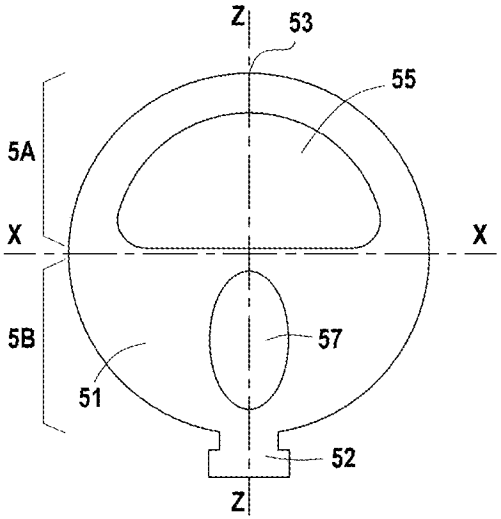
Figure 4:
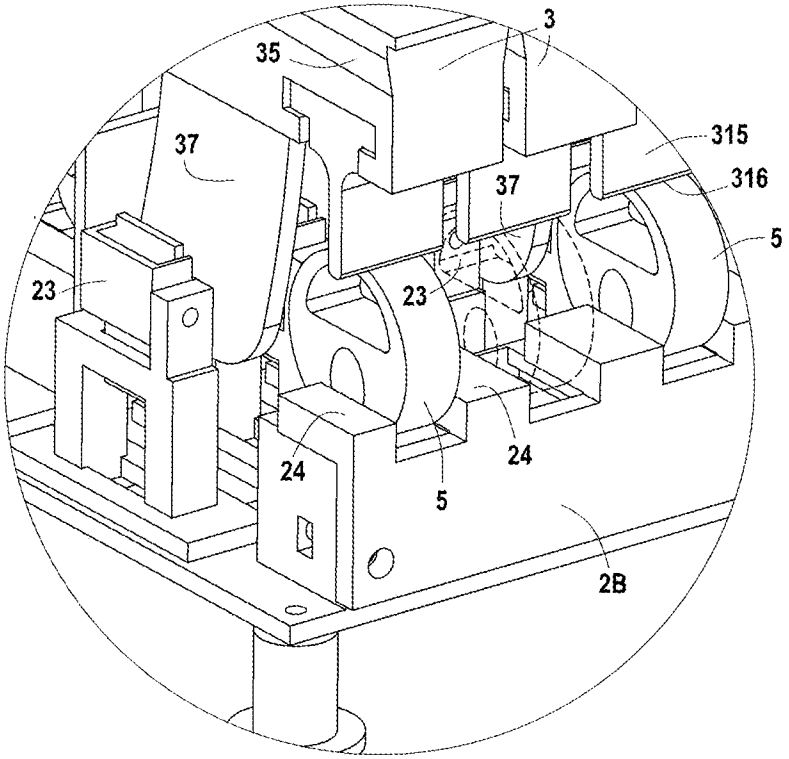

The damping element 5 as shown has the general shape of a cylinder equipped with a linking portion 52 forming her an excrescence having the general shape of a T, allowing facilitating its attachment to the base 2. FIG. 5 shows a side view of the damping element 5 illustrated in FIGS. 1 and 4. Also defined for the damping element 3 is a contact portion 53 corresponding to a portion of the damping element 3 suitable for coming into contact with the actuator 3. In the example illustrated, the contact portion 53 is the portion of the damping element 5 suitable for coming into contact with the protrusion 315 of the actuator 3. The contact portion 53 and the linking portion 52 may be positioned at two ends of the body 51 of the damping element 5; here these two portions are diametrically opposed. A compression direction of the damping element 5 is defined, corresponding to the direction defined by the contact portion 53 and the linking portion 52. In the example illustrated in particular in FIGS. 4 and 5, the compression direction is vertical and forms a diameter of the cylindrical section of the body 51 of the damping element 5. The compression direction is designated by an axis Z-Z in FIG. 5.

The protrusion 315 may extend in a compression direction defined by the axis Z-Z.

The damping element 5 includes a body 51 made of deformable material, for example a silicone or an elastomeric material, having the general shape of a cylinder. The body 51 in the shape of a cylinder may be positioned so that one axis of revolution of the cylindrical body is collinear with the pivoting axis 4. The body 51 has at least one recess. In the example illustrated, the body 51 has two separate recesses 55 and 57 having distinct shapes, the recesses may be through.

In the example illustrated, the two recesses 55 and 57 are formed so as to be superimposed relative to one another in the compression direction of the damping element 5. Thus the body 51 of the damping element can be subdivided into two portions; a first portion 5A and a second portion 5B each may correspond to a half-cylinder having a contact along a plane perpendicular to the compression direction. The two portions 5A and 5B are not necessarily equal; they can generally consist of two portions of the body 51 which is divided along a plane perpendicular to the compression direction. An example of such a plane and of division of the body 51 into two portions is shown by the axis X-X.

The first portion 5A is defined as being the portion of the body 51 comprising the contact portion 53, while the second portion 5B is defined as being the portion of the body 51 comprising the linking portion 52. The first portion 5A includes a first recess 55, which has a cross section having the general shape of a half-cylinder, the corners formed between the curved portion and the diameter of the half-cylinder having been rounded. The first recess 55 therefore has a cross section with a semicircular shape, the ridges of which have been rounded, and having a foot perpendicular to the compression direction. The second portion 5B includes a second recess 57 which has an oval cross section centered on and symmetric relative to the axis Z-Z defining the compression direction.

In the embodiment shown in FIG. 5, the first recess 55 occupies a large part of the first portion 5A, while the second recess 57 occupies a smaller part of the second portion 5B. The result is that the first portion 5A has less stiffness than the second portion 5B of the body 51 of the damping element 5.

In practice, during the displacement of the actuator 3, the latter will cause a compression of the damping element 5 in the compression direction. The first portion 5A, having a smaller stiffness, will be deformed first of all, thus defining a first damping profile. Once the first profile 5A is entirely deformed, which is manifested by matter continuity in the first portion 5A in the compression direction, the second portion 5B will be deformed, thus defining a second damping profile provided that the stiffness of the second portion 5B is greater than the stiffness of the first portion 5A.

The protrusion 315 is configured so as to retain a reduced contact surface with the damping element 5, particularly in order to avoid the formation of a planar contact during the deformation of the damping element 5, which would then limit the possible deformation of the damping element 5.

Figure 8:
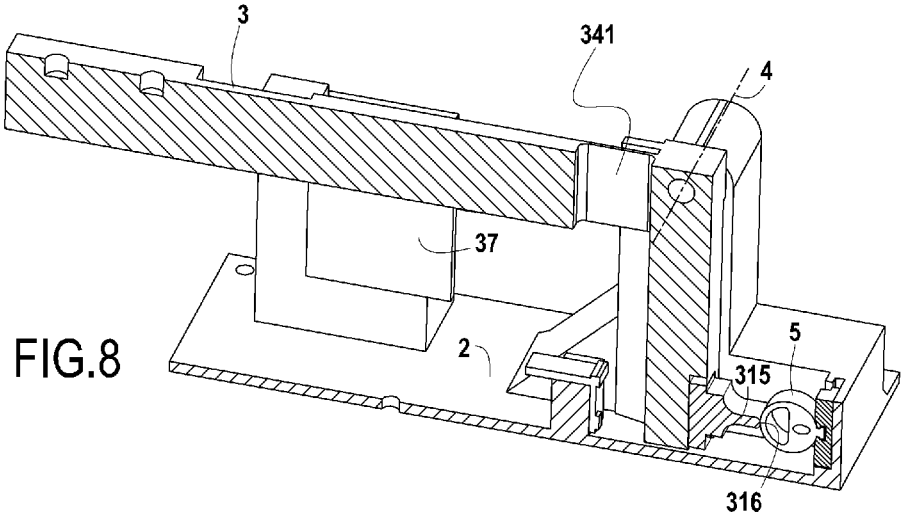
FIG. 8 shows a variant of the device shown in FIG. 1.

FIG. 8 shows an alternative configuration of the device shown in FIG. 1. Shown on this figure is a device 1 comprising a single actuator 3, it being understood that this variant can be applied to a device 1 comprising a plurality of actuators 3 as already shown with reference to FIG. 1.

In this embodiment, the damping elements 5 in what is qualified as a "rear" zone of the actuators, i.e. opposite to the tactile portion 31. Here the damping element is also secured to the base 2 (here the portion 2A of the base 2 forming the support of the pivoting axis 4), but the compression direction is horizontal here, and substantially perpendicular to the force application direction to the actuator 3 by the user. As for the embodiment already described previously, it is seen here that the protrusion 315 extends in the continuation of the compression direction defined by the axis Z-Z. This embodiment allows de-correlating the rotation movement of the actuators 3 from the translation movement of the tactile portion 31 of the actuators 3.

In fact, in the embodiment shown in particular in FIG. 1, the damping element 5 is positioned in contact with the protrusion 315 extending from the tactile portion 31 of the actuators 3. Consequently, the damping elements 5 will oppose a resistance force to the translation movement along the pivoting axis 4 of the actuators 3, this force being variable depending on the deformation of the damping element 5. The resistance force opposed by the damping element 5 will thus depend on the properties of the damping element 5 and on the position of the actuator 3.

Furthermore, it is noted that the damping can vary depending on the link between the damping element 5 and the base 2. If the linking portion 52 of the damping element 5 is considered, this may define a link extending along the pivoting axis 4 or perpendicular to the pivoting axis 4. In the case of a linking portion 52 extending perpendicular to the pivoting axis 4, this can allow a slight displacement in rotation of the damping element 5 around a junction point with the base 2; the damping element 5 can thus accompany the displacement in translation of the actuator 3 in a movement of the vibrato type. Conversely, in the case of a linking portion 52 extending parallel to the pivoting axis 4, the displacement in translation of the actuator 3 will cause a deformation of the damping element 5, and the latter will therefore oppose a resistance greater than that of an identical damping element 5 but having a linking portion extending perpendicular to the pivoting axis 4. The stops 24 adjacent to the damping element 5 in question then have an impact in that the limit the possible deformation of the damping element 5. It is understood, in fact, that the higher the stops 24, the more the portion of the damping element 5 is limited, and therefore the more the latter will oppose a considerable force to the translation movement of the tactile portion 31.

By contrast, in the embodiment shown in FIG. 8, the protrusion 315 coming into contact with the damping element 5 does not extend from the tactile portion 31, or more generally does not extend from the portion of the actuator 3 that is movable in translation along the pivoting axis 4. Consequently, the translation movement of the tactile portion 31 of the actuator 3 is not impacted by the damping element 5, inasmuch as the part of the actuator 3 in contact with the damping element 5 does not perform a translational motion.

The operation of this configuration remains unchanged relative to the operation of the embodiment described previously.

Figure 9:
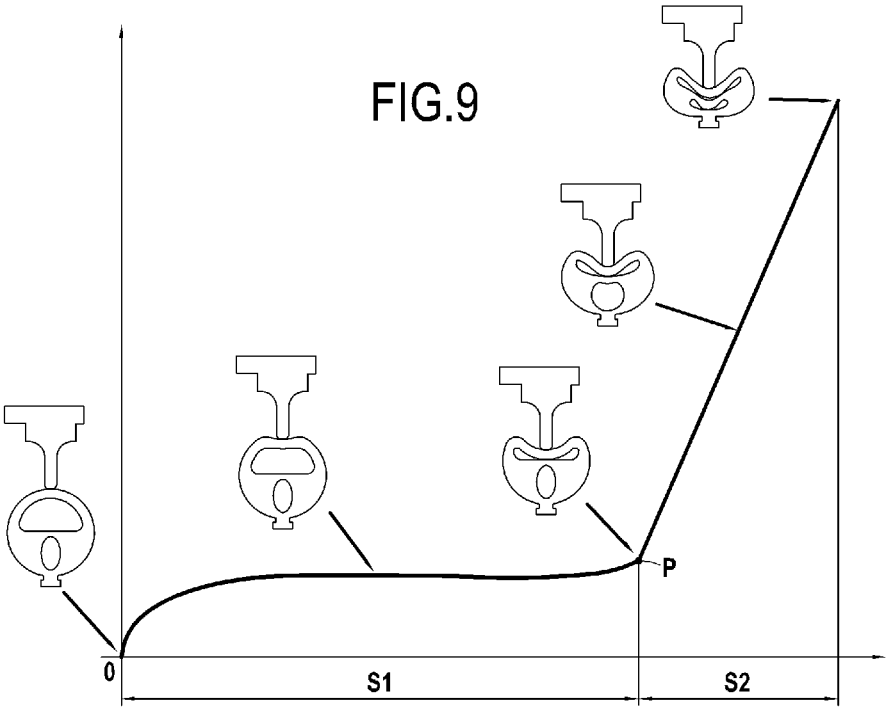
FIG. 9 is a graph illustrating the damping of the device depending on the depression of the actuators.
Figure 10:
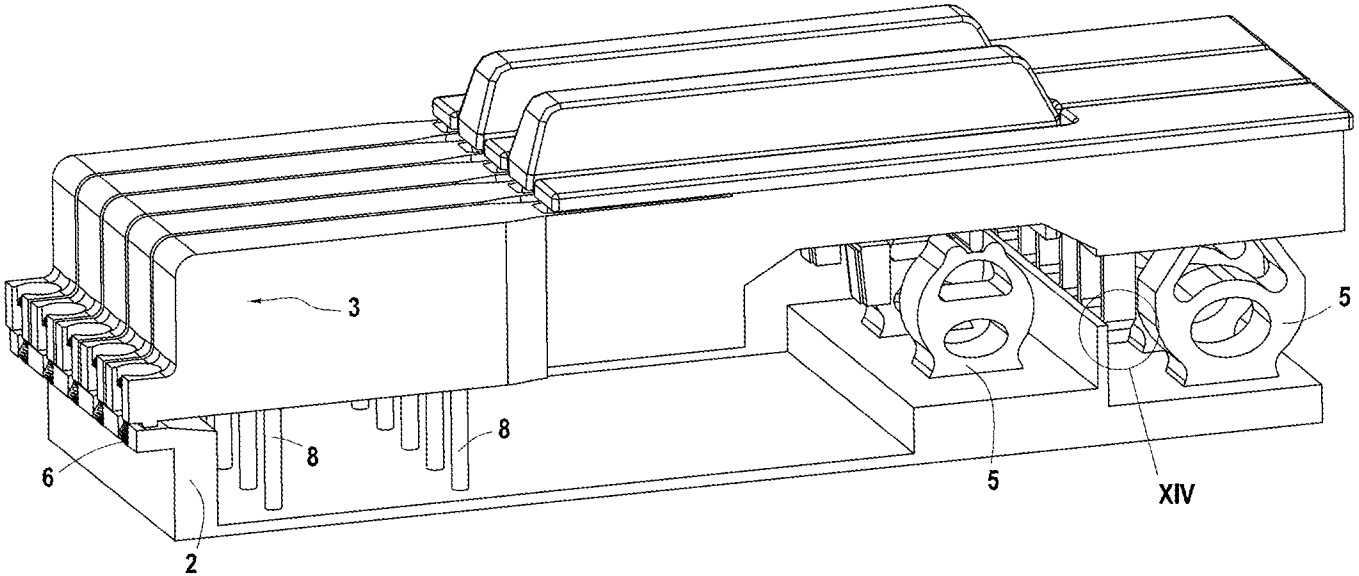
Figure 12:
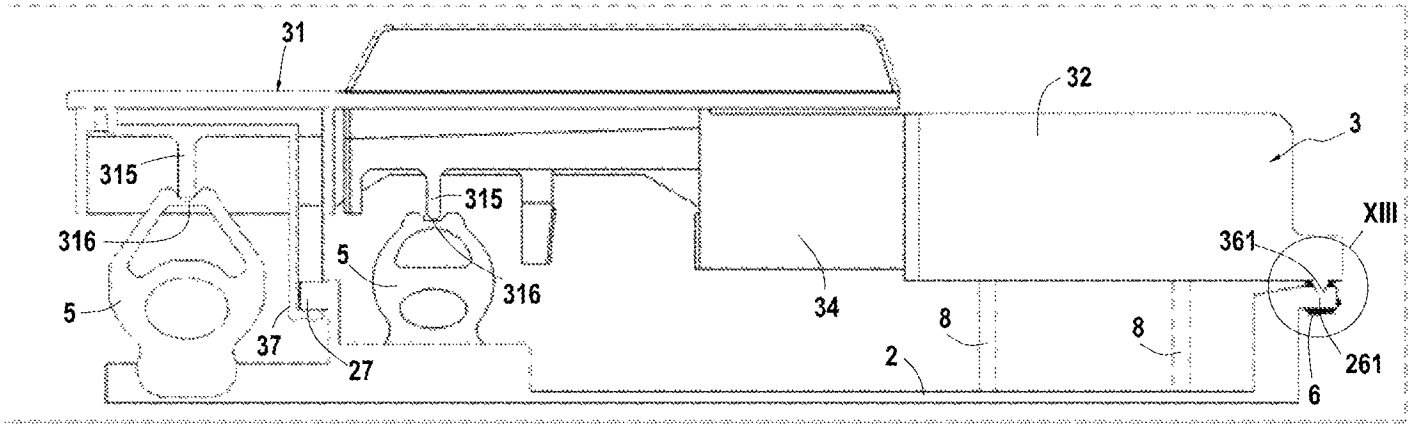

FIG. 9 is a graph illustrating schematically the behavior of the damping element 5 when subjected to a compression force as exerted by the operator 3.

Shown in this graph is the deformation of the damping element 5 on the horizontal axis, and the force applied by the actuator 3 to the damping element 5 on the vertical axis. The graph is therefore a graph that is designated force/depression. For the purpose of illustration several examples of deformation of the damping element 5 are also shown at different points of the graph.

Shown on the graph is a first section S1 in which the curve has a nonlinear profile, then a point P at which the curve may take on a linear profile for a second section S2.

The first section S1 has a general profile similar to a curve of the square root type. Thus it can be seen that the damping element 5 opposes a relatively high stiffness when the deformation of the damping element 5 is initiated, then that the stiffness is less, the deformation them being able to be modulated to a relative large degree with a very small variation of the force applied by the user. This first section S1 corresponds to the deformation of the first portion 5A of the damping element 5. It is understood in fact that the initiation of the deformation corresponds to a bending of the material in the compression direction. Once an initial deformation is accomplished, the damping element 5 will be able to deform over then entire height of the first recess 55 (the height being measured here in the compression direction), until the deformation of the first recess causes a continuity of matter on the first portion 5A in the compression direction.

The second section S2 corresponds to the deformation of the second portion 5B of the damping element 5, i.e. to the crushing of the second recess 57. The trace stops when the protrusion 315 comes into contact with the stop 24 associated with the base 2. The stop 24 being rigid, no displacement of the actuator 3 is then possible. In the absence of a stop 24 on the base 2, the trace stops when the damping element 5 is entirely compressed, which can in particular be manifested by the fact of having a continuity of matter in the second portion 5B in the compression direction, i.e. a crushing of the second recess 57 as shown schematically in FIG. 9.

As previously indicated, the cross section of the second recess 57 is reduced relative to the cross section of the first recess 55.

The damping element 5 therefore has a greater stiffness here, which is manifested by the high slope of the trace in the second section S2. Moreover, in this example the second recess 57 is dimensioned so that the second section S2 is linear.

This trace, having two distinct sections S1 and S2, is characteristic of the system according to the disclosure. In fact it allows obtaining two distinct sensations for a user actuator a controller 3, and thus to define two distinct levels of control. The point P symbolizes a break in the curve of the trace, which can be felt by the user. The proposed device 1 thus allows for example defining a first type of control when situated in the first section S1 of the graph and a second type of control when situated in the second section S2 of the graph. More generally, the device 1 allows obtaining two distinct profiles for damping the displacement of the actuator 3 in addition to a stop sensation during the curve break and thus conferring a force feedback to the user, and therefore conferring two distinct control sensations for a user.

It is understood, upon seeing the graph shown in FIG. 9, that the dimensioning of the elements forming the stops limiting the rotation movement of the actuators 3 will bound the curve, and can thus define portion of the curve that cannot be accomplished due to the presence of stops which prevent the actuator 3 from attaining the required positions for accomplishing the level of compression corresponding to the damping elements 5. The dimensioning of the elements forming the stops limiting the rotation movement of the actuators 3 as well as the dimensioning of the damping elements 5 thus allowing modifying the sensation of a user.

FIGS. 10, 11, 12, 13 and 14 show another example of a device 1 according to one aspect of the disclosure.

In this embodiment, the pivoting link between the actuators 3 and the base 2 is accomplished by means of surfaced defining a shape protruding from one of these elements, and a counter-shape accomplished in the other of these elements. In the example illustrated, the actuators thus have a fin 361 having a triangular cross section. The base 2 has grooves 261 also having a triangular cross section, but with a larger cross section. Thus, when the actuators 3 or set on the base 2, these surfaces allow a rotation movement of the actuators 3 relative to the base 2 along an axis corresponding to the contact at the tips of the fins and grooves.

In order to ensure maintenance in contact of the actuators 3 on the base 3, a tension spring 6 is positioned so as to exert a tension force, the direction of which is centered on the pivoting axis defined by the surfaces in contact between each actuator 3 and the base 2. The tension spring 6 thus ensures the durability of the system without impacting the pivoting movement, inasmuch as the direction of the force exerted by the tension spring 6 passes through the pivoting axis 4.

The base 2 as shown has a plurality of vertical rods 8 configured so as to define lateral stops for the foot 32 of each actuator 3. More precisely, the vertical rods 8 have a free end received in a recess provided in each actuator 3, the rods 8 being dimensioned so as to be in contact with internal walls of the foot 32 of each actuator 3 in the direction defined by the axis of rotation 4. Thus provision may be made for two rods 8 inserted in the foot 32 of each actuator 3. The rods 8 thus ensure retention in position of the feet 32 of the actuators 3 relative to the base 2, by allowing only a rotation movement along the pivoting axis 4. The rods 8 ensure in particular retention of the foot 32 of the actuators 3 when the user applies a translation movement of the tactile portion 31 of the actuators 3 as already previously described. An embodiment of this type allows in particular concentrating the stresses at the rods 8 and the slats 341 and 342 of the intermediate portion 34, and not at the pivoting link. It is understood that this embodiment is not to be interpreted in a limiting manner; the function achieved by the rods 8 can be achieved by any other suitable means.

When the translation movement of the foot 32 is thus limited by the rods 8, if the user manipulates the actuator 3 via the foot 32, he can then apply only a rotation movement to the actuator 3.

In the embodiment shown, each of the actuators 3 has a slot 37 extending from the lower face of the tactile portion 31. This slot faces a lug 27 formed on the base, and suitable to be inserted into the slot 37. The slot 37 has a cross section that increases from its lower end toward its upper end. In the example shown, the cross section of the slot 37 at its lower end corresponds to the cross section of the lug 27. The slot 37 and the lug 27 are configured to that in the absence of an outside force applied to the system 1, the lug 27 is positioned in abutment against the lower portion of the slot 37. Thus the lug 27 accomplishes a stop function preventing the movement of the actuator 3 in the form of a rotation movement in the direction opposite to the depression direction. Moreover, the association of the lug 27 and the slot 37 allows ensure an alignment of each of the actuators 3 in its initial position (i.e. when a user does not apply a force to the actuators 3), and also allows defining a preloaded initial position for the actuators 3 on their associated damping elements 5, so as to ensure both a return to the initial position and maintenance in contact of each actuator 3 on its damping element 5.

When a user applies a force tending to depress the actuator 3, the slot 37 moves with the actuator 3; thus the lug will no longer be in abutment against the lower end of the slot 37. The cross section of the slot 37 then increases, which allows displacement of the lug 27 in the slot 37, and therefore allows a translation movement of the actuator in a direction defined by the pivoting axis 4 which becomes greater as the cross section of the slot 37 increases. It is thus possible to create a slot 37, the cross section of which increases progressively so that the possible amplitude of translation increases with the depression of the actuator 3.

The lugs 27 may have a cylinder-of-revolution cross section, along an axis parallel to the main direction of the associated actuator 3.

In a variant (not shown) the slot 37 can have a fin forming a stop limiting the displacement of the actuator 3 in the depression direction. The lug 27 then moves between a high stop and a low stop, which delimits the angular amplitude of the rotation of the actuator 3.

Figure 15:
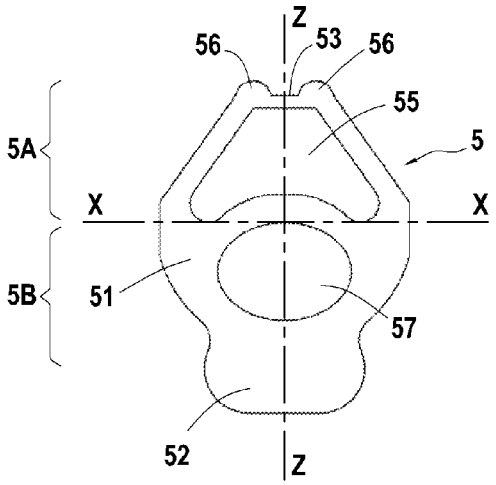
FIGS. 15 to 19 show schematic examples of damping elements.
Figure 16:
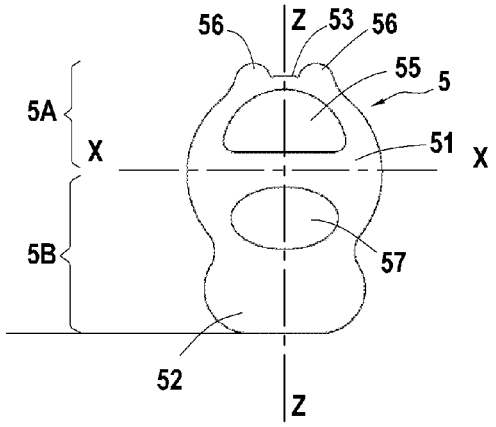

FIGS. 15 and 16 show views of the exemplary embodiments of the damping elements 5 visible in this embodiment. The device 1 may have several damping elements 5 having distinct shapes, particularly depending on the configuration of the actuators 3.

Found on these two figures are two examples of damping elements 5 having in particular the different features already described with reference to FIG. 5, and designated with the same numerical symbols.

In these embodiments, the linking portion 52 forms an excrescence on the lower portion of the body 51. This linking portion 52 may have through bores to insert holding elements into it, or be mounted clamped between clamping elements of the base 2.

Here the contact portion 53 is a substantially flat (FIG. 15) or curved (FIG. 16) portion. It is surrounded by two bosses 56 suitable for improving the centering of the damping element 5 relative to the protrusion 315 of the associated actuator.

In these two variants, the second recess 57 has an oval cross section. In the embodiment shown in FIG. 16, the first recess has a generally semicircular section, of which the corners are rounded. In the embodiment shown in FIG. 17, the first recess 55 as shown has a trapezoidal shaped cross section of which the larger base is curved, which may be so as to conform to the external contour of the second recess, and the linking portions of which, between the large base and the sides, are rounded.

The operation is similar to the operation already described with reference to the preceding figures.

Figure 17:
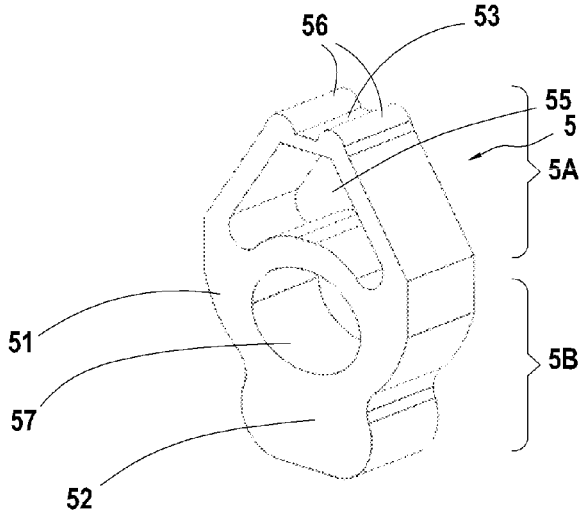
Figure 18:
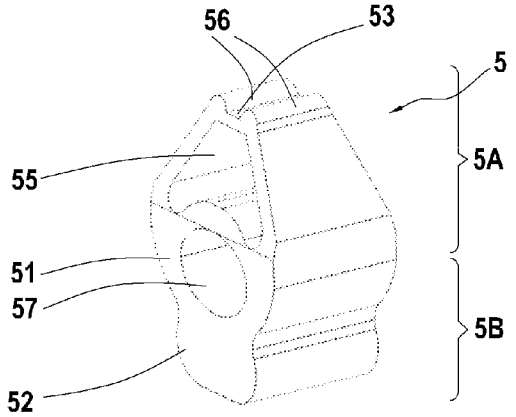
Figure 19:
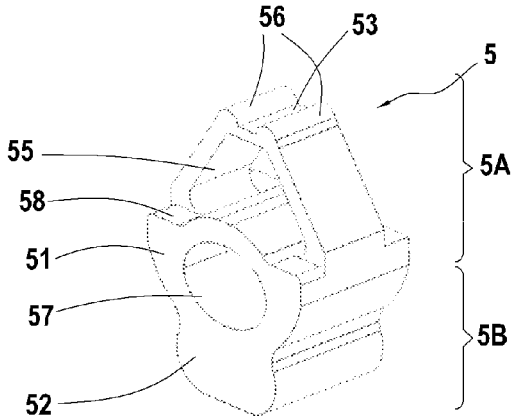

FIGS. 17, 18 and 19 show three variants of the damping element already shown in FIG. 15.

FIG. 17 is a perspective view of the damping element shown in FIG. 15. This damping element 5 may have a substantially constant thickness over its entire height, the height being the dimension along the axis Z-Z (or compression direction), and the thickness being measured along the axis Y-Y perpendicular to the axis Z-Z and the axis X-X, corresponding if appropriate to the direction defined by the linear contact between the damping element 5 and the actuator 3.

FIG. 18 is a variant of the damping element shown previously in FIG. 17, in which the thickness of the damping element decreases over its first portion 5A. More precisely, the thickness of the damping element 5 decreases from the limit between the second portion 5B and the first portion 5A until the upper end of the damping element 5.

An embodiment of this type allows for example to vary the resistance exerted by the damping element 5 to a translation movement along the pivoting axis 4. The more the damping element 5 is compressed, the more it will exert a resistance opposing a translation movement due to the increase in its cross section.

FIG. 19 shows another variant of the damping element previously shown in FIG. 17. In this embodiment, the second portion 5B has a greater thickness than that of the first portion 5A. A shoulder 58 is thus formed between the first portion 5A and the second portion 5B. This shoulder thus causes an abrupt variation of thickness, and therefore an abrupt variation of the resistance force exerted by the damping element 5 to a translation force when the compression of the damping element 5 (and therefore its deformation) reaches a given level.

It is understood that the examples presented in the different figures can be combined, and that the different structural and functional details shown in the different embodiments can be associated in different combinations. The embodiments shown are thus not to be interpreted in a limiting manner.

It is understood, upon reading the foregoing, that the proposed device 1 allows offering a haptic controller suitable for use in particular in the musical environment, allowing improved and modulable control due to the fact of the different degrees of freedom and behavior of the actuators 3. The example illustrated in the figures allows in particular reproducing the force feedback of a conventional piano for a user, which the various known controllers and keyboards do not allow.

Moreover, the different damping elements 5 are removable. It is thus possible for the same device 1 to replace the damping elements 5 if the latter are worn of if it is desired to modify the behavior of the device 1.

It is also understood that the shape of the damping elements 5 can vary. In the example illustrated, these are elements having the general shape of a cylinder, having two recesses. More generally, each damping element has at least one recess. As a variant, it is also possible to create a damping element by means of two materials or more having distinct mechanical properties, which can also allow modifying the stiffness opposed to the compression force applied by the actuator 3 to the damping element 5 depending on the deformation of the damping element 5.

The device 1 may include a plurality of sensors suitable for measuring the displacement in rotation and in translation of the actuators 3 and deliver a signal depending on this displacement.

The sensors can for example be magnetic sensors coupled to a magnetic element such as a magnet positioned on each actuator 3. The sensors can also be sensors measuring the force applied to the associated actuator 3.

As a variant, the sensors can be positioned so as to measure the rotation of the actuators 3 around the pivoting axis 4; sensors of this type can be positioned so as to measure the rotation of the actuators 3 around the pivoting axis 4; sensors of this type can for example be positioned at the pivoting axis 4, or be coupled to a dedicated surface of each actuator which can for example have graduations or markings thus allowing defining the position of each actuator 3 by means of an optical sensor.

In the example shown in FIG. 1, each actuator 3 includes a measuring portion 37 extending from the lower surface of the tactile portion 31 of the actuator 3. The measuring portion 37 includes a flat surface which can for example be provided with visual references such as graduations or indentations. The base 2 includes an optical sensor 23 positioned facing each measuring portion 37, so as to measure the displacement of the measuring portion 37 and therefore the displacement of the actuator 3 in rotation around the pivoting axis 4. The actuators 3 can also have a reflecting surface, which thus allows measuring, with the help of a sensor, the displacement in translation along the pivoting axis 4 of the tactile portion 31 of the actuator 3.

Generally, the device includes a set of sensors suitable for supplying information relating to the displacement in rotation of the actuator 3 around the pivoting axis 4 and to the movement in translation of the tactile portion 31 of the actuator 3 along the pivoting axis 4, this information being able to include in particular the position of each actuator at a given instant, as well as the displacement speed of each actuator and its acceleration.

The device 1 can also include a computer, or more generally a signal processing unit, suitable for correlating the displacement of the actuators 3 to predetermined gestures such a musical gestures. The device 1 can then modulate the signal delivered depending in particular on the speed and the acceleration during the displacement of each actuator 3, in addition to its position.

The proposed device therefore forms a haptic controller offering a large and modulable control amplitude, and allowing in particular proposing an association between two distinct damping profiles, differentiated by a stop sensation resulting from the break in the damping curve, coupled with the possibility of achieving a vibrato effect.

These different levels of movement may thus be able to be translated through different actuating and sound control messages. The two damping profiles then offer two continuous control levels for sonic parameters, such as for example volume information or the cutoff frequency of a filter. According to one example, a speed or an acceleration is calculated shortly before the stop sensation to launch a discrete velocity information, currently used in conventional keyboard to actuate a note. Finally, the translation may allow continuously varying the height of a note (controls commonly designated "vibrato" and "bending").

Although the present disclosure has been described by referring to specific exemplary embodiments, it is obvious that modifications an changes can be carried out on these examples without departing from the general scope of the disclosure as defined in the claims. In particular, individual features of the different embodiments illustrated/mentioned can be combined into additional embodiments. Consequently, the description and the drawings must be considered in an illustrative, rather than a restrictive sense.

It is also obvious that all the features described with reference to a method are transposable, alone or in combination, to a device, and conversely, all the features described with reference to a device are transposable, alone or in combination, to a method.

The invention claimed is:

1. A haptic controller comprising:

a base, a plurality of actuators, each having a shape elongated in a main direction, each actuator being mounted pivotally relative to the base along a pivoting axis perpendicular to the main direction, a plurality of damping elements, each damping element being positioned so as to dampen a rotation movement of an actuator around the pivoting axis in a compression direction, said damping elements being elastically deformable between an initial configuration and a final configuration, each damping element comprising a body of deformable material, said body having at least two separate through recesses superimposed relative to one another in the compression direction of the damping element, said at least two through recesses of each damping element being through in a direction defined by the pivoting axis, and wherein, each of said actuators have a protrusion suitable for coming into contact with the associated damping element, and each protrusion has a free end defining a contact with the associated damping element in its initial configuration.

2. The haptic controller according to claim 1, wherein said recesses have distinct shapes.

3. The haptic controller according to claim 1, wherein said damping elements are removable.

4. The haptic controller according to claim 1, wherein the base defines an abutment limiting the displacement in rotation of each actuator in the compression direction.

5. The haptic controller according to claim 1, wherein the base and the actuators comprise portions cooperating so as to define an abutment limiting the displacement in rotation of each actuator in the direction opposite to the compression direction, and defining an initial position of each actuator on their associated damping elements in which the damping elements are preloaded by the actuators.

6. The haptic controller according to claim 1, wherein each of said actuators comprises a tactile portion and a foot, the tactile portion being movable in translation relative to the foot in a direction defined by the pivoting axis.

7. The haptic controller according to claim 6, wherein the foot of each actuator comprises a pivoting portion defining the pivoting link with the base, the pivoting portion being connected to the tactile portion by two parallel slats each extending in a plane perpendicular to the pivoting axis.

8. The haptic controller according to claim 1, wherein each actuator comprises a pivoting portion defining the pivoting link with the base, and allowing displacement in rotation of the actuator along an axis perpendicular to the pivoting axis and perpendicular to the main direction.

9. The haptic controller according to claim 6, wherein the base comprises a plurality of elements protruding from the base, each element being configured so as to be supported against two walls of the foot of an actuator in a direction parallel to the pivoting axis.

10. The haptic controller according to claim 1, wherein said actuators are configured so as to allow a displacement in translation that is variable depending on the rotation of the actuators around the pivoting axis.

11. The haptic controller according to claim 1, wherein the damping element is connected to the base by means of a linking portion extending in a direction perpendicular to the pivoting axis or in a direction parallel to the pivoting axis.

12. The haptic portion according to claim 1, wherein the damping portion has a variable thickness, the thickness being the minimum dimension of the damping element along an axis perpendicular to the compression direction.

13. The haptic controller according to claim 1, wherein the body of each damping element has a cylindrical shape, of revolution for example, along an axis parallel to the pivoting axis.

14. The haptic controller according to claim 1, wherein each actuator comprises two distinct linking elements forming two pivoting links separate from the base along the pivoting axis.

15. The haptic controller according to claim 1, wherein said damping elements are configured so as to dampen the rotation movement of the actuator by opposing a damping having two distinct profiles depending on the rotation of the associated actuator, the passage from the first to the second profile defining a break in a damping curve depending on the rotation of the actuator.

16. The haptic controller according to claim 1, wherein the body of the damping element is subdivided into a first portion and a second portion along a plane perpendicular to the compression direction.

17. The haptic controller according to claim 16, wherein the first portion of the body has a first stiffness, the second portion of the body has a second stiffness, and the first stiffness of the first portion of the body is less than the second stiffness of the second portion of the body.

18. The haptic controller according to claim 16, wherein the first through recess occupies part of the first portion of the body, the second through recess occupies part of the second portion of the body, and the part of the second portion of the body occupied by the second through recess is smaller than the part of the first portion of the body occupied by the first through recess.

* * * * *